United States Patent [19]

Korte-Jungermann

[11] Patent Number: 4,949,968

[45] Date of Patent: Aug. 21, 1990

[54] RACKET FOR BALL GAMES, IN PARTICULAR TENNIS, AS WELL AS STRINGING DEVICE THEREFOR

[76] Inventor: Hans-Werner Korte-Jungermann, KleinKollenburg Strasse 58, D-4156 Willich 2(DE), Fed. Rep. of Germany

[21] Appl. No.: 195,077

[22] PCT Filed: Sep. 16, 1987

[86] PCT No.: PCT/DE87/00418

§ 371 Date: May 17, 1988

§ 102(e) Date: May 17, 1988

[87] PCT Pub. No.: WO88/01889

PCT Pub. Date: Mar. 24, 1988

[30] Foreign Application Priority Data

Sep. 18, 1986 [DE] Fed. Rep. of Germany ..... 8624290

[51] Int. Cl.[5] ..... A63B 51/14

[52] U.S. Cl. ..... 273/73 A; 273/73 B; 273/73 D

[58] Field of Search ..... 273/73 R, 73 A, 73 B, 273/73 C, 73 D

[56] References Cited

U.S. PATENT DOCUMENTS

| | | | |
|---|---|---|---|
| 2,040,194 | 5/1936 | Whiteside | 273/73 B |
| 2,091,654 | 8/1937 | Roberts et al. | 273/73 B |
| 3,664,668 | 5/1972 | Held | 273/73 C |
| 3,994,495 | 11/1976 | Stoffel | 273/73 D |
| 4,140,316 | 2/1979 | Coupar | 273/73 D |
| 4,484,742 | 11/1984 | McCrone et al. | 273/73 A |

*Primary Examiner*—William H. Grieb

*Attorney, Agent, or Firm*—Mason, Kolehmainen, Rathburn & Wyss

[57] ABSTRACT

A racket for ball games, in particular tennis, comprises a stringing system in the form of individual strings. The individual strings are each held in the racket frame by means of rivet sleeves, with the rivet heads bearing against the outer edges of the holes in the racket frame. In the event of a string breaking, there is no reaction on the adjoining strings, and only the broken string has to be changed. The individual strings which are provided for the first stringing or for replacement stringing have a fixedly disposed rivet sleeve at one end. In addition there is a loose rivet sleeve which is intended for being pushed on and connected after the string has been inserted into oppositely disposed holes. In addition described is a stringing device of simple design, by means of which individual strings can be easily replaced even by technically unskilled persons.

10 Claims, 3 Drawing Sheets

RACKET FOR BALL GAMES, IN PARTICULAR TENNIS, AS WELL AS STRINGING DEVICE THEREFOR

BACKGROUND OF THE INVENTION

1. Field of the Invention

The invention relates to a racket for ball games, in particular tennis, comprising stringing for the surface of the racket, the stringing being passed through holes in the frame, a string which can be used for stringing purposes and a stringing device.

2. Description of Related Art

Rackets for ball games, in particular tennis rackets, are strung by a string being passed for example from the inside outwardly through holes in the rim of the racket, turned around and then passed from the outside inwardly again in the adjoining hole, thus providing generally a meander-type string configuration. If one string breaks, that naturally also affects the adjoining strings so that in that case in practice all the stringing has to be renewed. Another disadvantage of rackets with the known kind of stringing is that, as a result of the strings being turned around, the regions of adjoining holes, which are respectively towards each other, are subjected to high forces (referred to as hole edge forces) which can sometimes result in breakage, in particular after the racket has been in use for a prolonged period of time. Another disadvantage is that the operation of stringing rackets has to be carried out by means of expensive stringing devices which generally can only be operated by expert operators.

OBJECTS OF THE INVENTION

In order to overcome the above-indicated disadvantages, the invention seeks to provide a racket stringing arrangement that, in the event of breakage of a string, does not have any reaction on the adjoining strings so that only broken strings have to be replaced, and an arrangement wherein string replacement can be effected in a very simple fashion without an expensive stringing device.

SUMMARY OF THE INVENTION

In accordance with the invention, to solve the above problems, it is firstly provided that, in the case of a racket of the kind set forth in the opening part of this specification, the stringing has respective individual strings between oppositely disposed holes and the individual strings are held in the racket frame by means of rivet sleeves which fixedly embrace the strings and whose rivet heads bear against the outer edges of the holes. In that way the stringing of the racket has a number of individual strings corresponding to the number of mutually intersecting strings. By compressing the rivet sleeves which are disposed at the ends, it is easy to provide for a fixed connection between the rivet sleeves and the strings. The desired prestressing of the strings can be achieved in that a respective string which carries a fixedly disposed rivet sleeve only at one end is passed with its free end which does not have a rivet sleeve thereon through a hole in one edge of the frame and is then passed to the oppositely disposed side of the frame, possibly crossing over transverse strings which are already provided in the frame, and is then passed through the corresponding hole in an opposite side of the frame. Then, at that position, so-to-speak from the outside, a rivet sleeve is fitted onto the string, the string is prestressed and then the rivet sleeve is compressed so that it is also fixedly connected to the string and then, due to the prestressing applied, the rivet sleeve is allowed to slip into the hole in the rim of the racket in such a way that the rivet head comes to bear against the outer edge of the hole. As the prestressing which is initially applied to the string decreases by virtue of the rivet sleeve sliding into the hole, it will be appreciated that account is to be taken of that fact when determining the level of prestressing to be applied.

Because each string is fixed independently of other strings, in the event of such a string breaking it is possible to perform a repair by replacing only that individual string.

In another embodiment of the invention it can be provided that disposed between the rivet heads and the outer edges of the holes are respective supports or underlays of resilient material, preferably plastic material.

Another embodiment of the invention may provide that the rivet sleeves are surrounded by a protective tube. The protective tube can advantageously serve to facilitate the sliding movement of the rivet sleeve into the hole.

The individual strings which can be used for the first stringing or also for replacement stringing are characterized in that a rivet sleeve is fixedly disposed at one end of the respective individual string and that there is provided a loose rivet sleeve which is intended for being pushed onto and connected to the string after the string has been introduced into oppositely disposed bores.

The adhesion of the string in the rivet sleeve can be increased if the rivet sleeves have internal grooving or serrations. If the rivet sleeves are longer than the thickness of the racket frame, then for connection to the individual string, the rivet sleeve may be compressed not only at the outward side of the frame but also at the inward side of the frame, thereby enhancing the strength of the connection. If the rivet sleeve which is possibly surrounded by a protective tube projects lightly into the stringing area, that is also advantageous as that reduces or prevents chafing of the string in the holes in the racket frame.

For the purposes of carrying the invention into effect, it is readily possible to use conventional racket frames, by replacing the hitherto conventional stringing with the stringing according to the invention.

The device for stringing the rackets provided in accordance with the invention is characterized in that there is provided a tensioning device which operates in the manner of a torque wrench and which has a contact portion which can be fitted onto the rim of the racket, and a holding portion which is provided for bearing against the inward edge of the racket frame and which is movable and which can thus be set to different racket frame thicknesses. The contact portion provides support for a string prestressing device which can be actuated by way of the lever or the like, with a clamping means for holding fast the string, and a measuring means for indicating the degree of prestressing attained. There is also provided means for compressing the rivet sleeve when the string is in a prestressed condition. The tensioning means and the compressing means are preferably in the form of separate components.

In a further embodiment of the invention the clamping means has a clamping surface which is fixedly mounted on the contact portion and a clamping disc which is designed or arranged to be eccentrically pivotable. The clamping disc is preferably prestressed relative to the clamping surface by a string in the opposite direction to the string tensioning direction.

In an advantageous embodiment, the measuring means is in the form of a scale.

In addition, it may be provided in accordance with the invention that the prestressing means which is actuatable by way of a lever or the like has a ratchet with a disengageable locking pawl. Finally it may be provided in accordance with the invention that the holding portion is displaceably mounted on the contact portion.

The stringing device, the function of which will be described in greater detail with reference to the embodiment shown by way of example in the drawings is of relatively simple construction so that individual strings can be easily replaced even by technically unskilled persons.

Another advantage of the invention is that the transmission of force from the string to the racket occurs only by way of the rivet head and the forces are uniformly distributed to the region surrounding the hole so that there are no forces acting transversely with respect to the longitudinal direction of the string.

As the impact area of a ball generally lies at the center of the stringing, the strings which are at the center are subjected to the greatest loadings. Accordingly the strings which are further away from the center of the racket are subjected to substantially lower loadings. The strings generally break in the middle region. As in accordance with the invention, the string can be individually replaced, that means that the substantially longer service life of the strings in the "other" areas of the stringing can be fully utilized so that overall the stringing of a racket in accordance with the invention can last for substantially longer than conventional stringing.

BRIEF DESCRIPTION OF THE DRAWINGS

The invention is described in greater detail hereinafter by means of embodiments as illustrated in the drawings in which.

DESCRIPTION OF THE PREFERRED EMBODIMENT OF THE INVENTION

Figure 1:
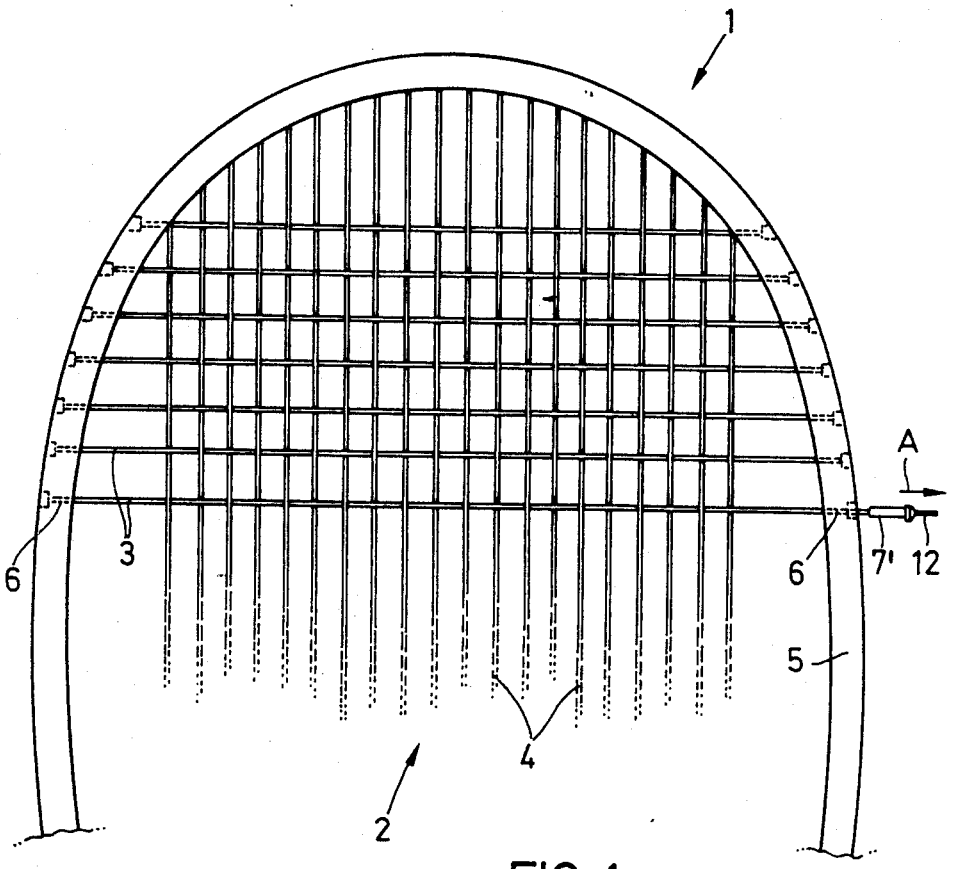
FIG. 1 is a plan view of a portion of a racket according to the invention.

A racket head, which is generally identified by reference numeral 1, of a racket for ball games, in particular tennis, has stringing which is generally identified by reference numeral 2. The stringing 2 consists of individual strings 3 which are disposed in the transverse direction and individual strings 4 which are disposed in the longitudinal direction. The frame of the racket head 1, which is identified by reference numeral 5, has in known manner holes 6 for receiving the transverse strings 3 and (not shown) in a corresponding fashion holes for receiving the longitudinal strings 4. The ends of the individual strings 3 and 4 are each fixedly embraced by rivet sleeves 7. The outside diameter of the rivet sleeves 7 is smaller than the inside diameter of the holes 6. The rivet sleeves 7 each have a respective rivet head 8 whose outside diameter is larger than the inside diameter of the holes 6. In the illustrated embodiment, the outer edges 9 of the holes 6 are recessed, more particularly in such a way that in the condition of use of the racket, the rivet heads 8 do not project beyond the outward surfaces of the rim of the frame 5. The strings 3 and 4 are held in the frame 5 in a prestressed condition in that the rivet heads 8 bear against the outer edges 9 of the holes 6. In the illustrated embodiment, a support 10 of resilient material, preferably plastic material, is arranged between the edges 9 of the holes and the rivet heads 8. The rivet sleeves 7 are also enclosed by a protective tube 11. The protective tube 11 which preferably comprises resilient material facilitates in particular the sliding movement of the rivet sleeves 7 into the holes 6.

Figure 2:
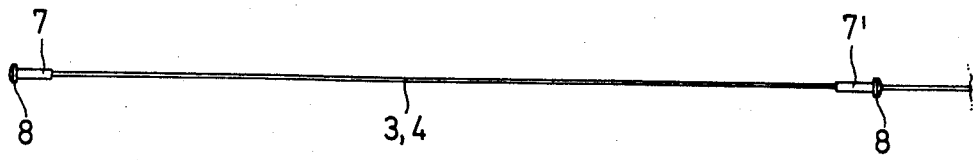
FIG. 2 is a view of an individual string.

FIG. 2 shows one of the individual strings 3 and 4 prior to the stringing operation. The length of those individual strings advantageously corresponds at least to the maximum length of the longest string of the racket. A rivet sleeve 7 with the rivet head 8 is fixedly disposed at the end of the individual string which is shown at the left in the drawing. The fixed connection can preferably be achieved by the rivet sleeve 7 which is pushed onto the string having been compressed by means of a suitable device in such a way that the rivet sleeve 7 fixedly embraces the string. There is also provided a loose rivet sleeve which is identified by reference numeral 7' in FIG. 2 and which can be pushed onto the free end of the string (at the right in the drawing).

The operation of fitting the individual strings then takes place in such a way that each of the individual strings 3 and 4 is passed through one of the holes 6 from the outside, with the "free" end of the string, which therefore does not have any fixedly disposed rivet sleeve thereon, and that then the inserted string crosses transversely extending strings if such are already provided, and then the free end is passed from the inside through the hole 6 which is in opposite relationship to the first hole 6. As the fixedly disposed rivet sleeve 7 is at the rearward end, that rivet sleeve 7 is drawn into the hole 6 and the rivet head 8 bears against the edge 9 of the hole. The free end of the individual string then projects out of the oppositely disposed hole 6. One of the rivet sleeves 7' is then pushed onto the free end of the string from the outside. Then, a prestress is applied to the projecting end 12 of the string in the direction of the arrow A (FIG. 1) and then the rivet sleeve 7' is fixedly connected to the individual string 3 by compressing. When now the end 12 of the string 3 is released, as a result of the previously applied prestressing the string 3 contracts so that the rivet sleeve 7' is then drawn into the corresponding hole 6.

As a result, the rivet head 8 of the rivet sleeve 7' comes to bear against the corresponding edge 9 of the hole 6. The free end 12 which projects beyond the head 8 of the rivet sleeve 7' is cut off.

It will be appreciated that in that condition the prestressing of each individual string in the condition of use of the racket is lower than the prestressing which was applied in the direction indicated by the arrow A during the tensioning operation. However, that fact can be readily taken into account.

A device for stringing the racket comprises a tensioning means which is generally identified by reference numeral 13 and an upsetting means which is generally identified by reference numeral 14. The tensioning means 13 operates in the manner of a torque wrench and has a contact portion 15 which can be fitted onto the racket rim 5 and a holding portion 16 which is provided for bearing against the inward edge of the racket and which is movable and which can thus be set to different frame thicknesses. The holding portion 16 is of a plate-like configuration and is displaceably mounted to the contact portion 15 by way of a wing nut 17. For that purpose the contact portion 15 has a plurality of holes 18, 19 and 20. Provided in opposite relationship on the contact portion is a contact pin 21. In addition, a lever 22 is mounted pivotably in the tensioning means 13, at 23. When the lever 22 is pivoted in the direction indicated by the arrow B in the contact position shown in FIG. 3, towards the racket frame 5, then the lever portion 24 which is in opposite relationship to the pivot axis 23 is pivoted in the direction indicated by the arrow C. Provided on the lever portion 24 is a clamping means 25 for fixedly clamping the end portion 12 of a string 3. The tensioning means 13 also has a measuring means in the form of a scale 26 for indicating the degree of prestressing achieved as well as a ratchet 26 with a spring-biased disengageable locking pawl 27 which engages into retaining notches 28 in the contact portion 15.

Figure 3:
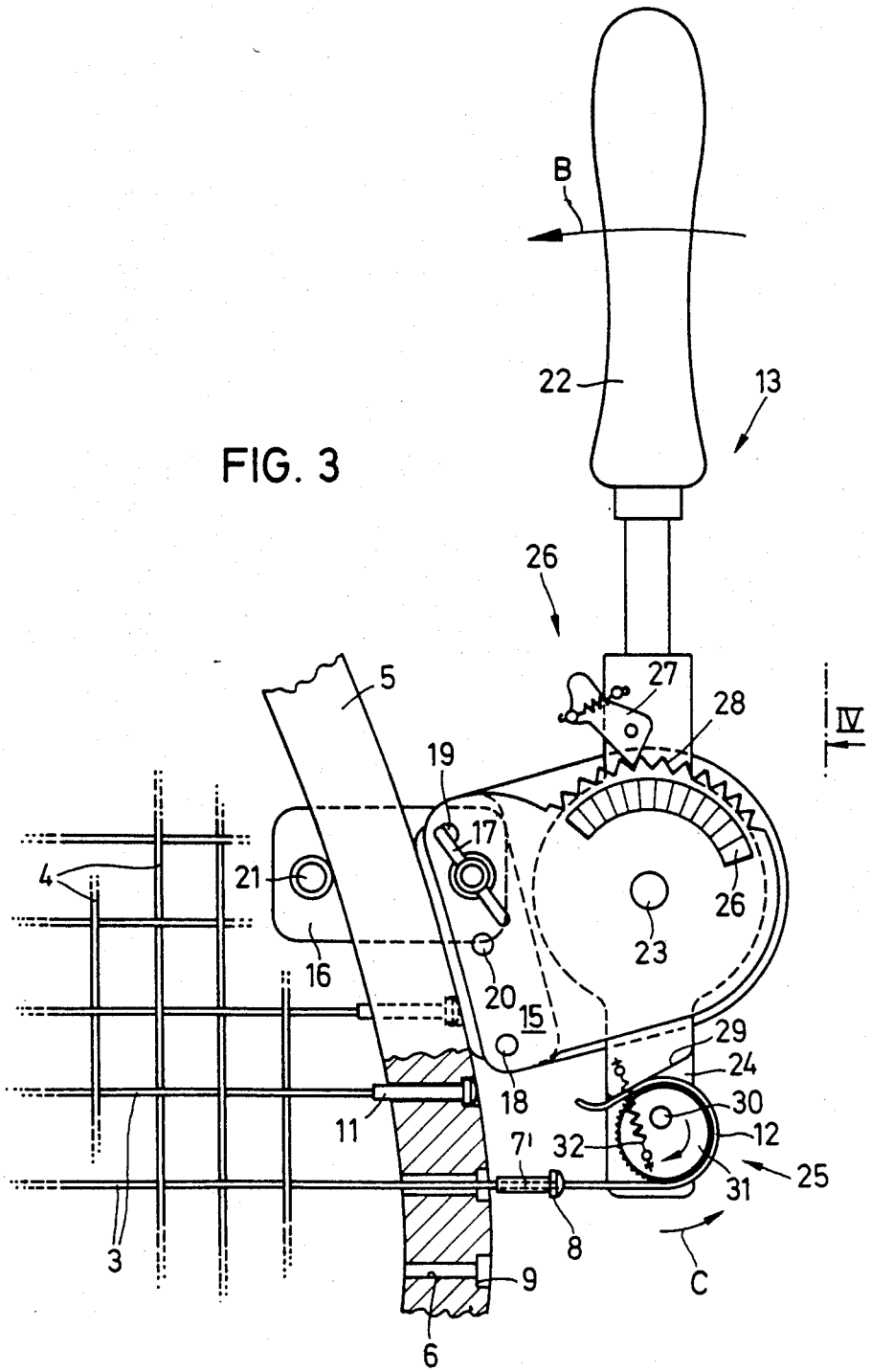
FIG. 3 is a diagrammatic view of a stringing device which is fitted to the frame of a racket.
Figure 4:
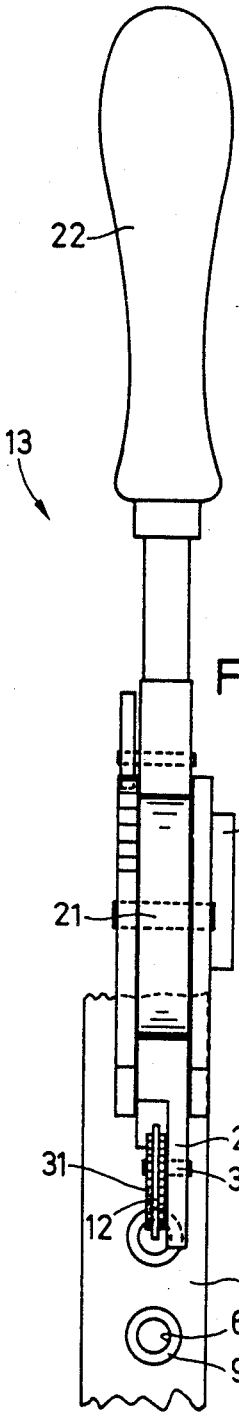
FIG. 4 is a view of part of the device shown in FIG. 3, shown in the direction indicated by the arrow IV in FIG. 3.

The clamping means 25 has a clamping surface 29 which is fixedly provided on the contact portion 15 and a clamping disc 31 which is mounted eccentrically at 30 and which is biased by a spring 32 in the opposite direction to the direction A (or C) of tensioning of the string 3. The mode of operation of the tensioning means 13 is as follows:

The tensioning means is fitted to the racket frame 5 as illustrated in FIG. 3 and the free end 12 is introduced into the clamping means 25 after the rivet sleeve 7' has been fitted into the string. The lever 22 is then actuated in the direction indicated by the arrow B. As a result of the eccentric clamping disc 31 and the tensioning spring 32, the free end 12 of the string 3 is held fast upon a pivotal movement in the direction indicated by the arrows B and C respectively. Due to the effect of the ratchet 26, the respective prestressing applied is maintained, the magnitude of which can be read off at the scale 26.

Figure 5:
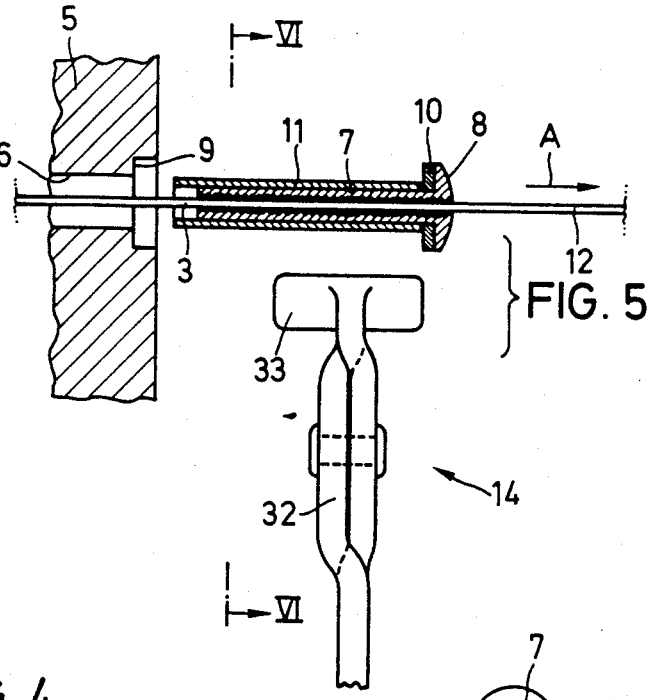
FIG. 5 is a detail view of the string which is shown in a tensioned condition by virtue of the stringing device and as illustrated in FIG. 3, and in addition with a side view of a rivet compressing device in the form of a pair of tongs.
Figure 7:
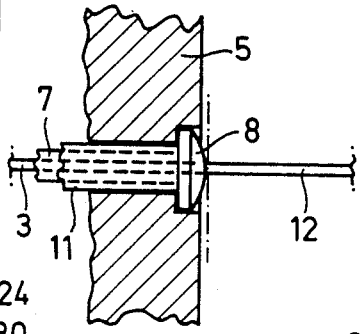
FIG. 7 is a diagrammatic view of the string which has slipped under prestressing into the hole, with the rivet sleeve, wherein the projecting end has not yet been cut off.
Figure 6:
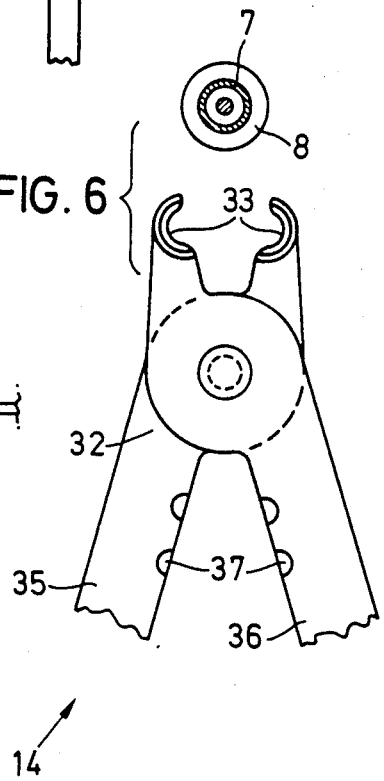
FIG. 6 is a view in section taken along line VI–VI in FIG. 5.

The rivet sleeve comprising means 14 which is shown in diagrammatic form in FIGS. 5 and 6 is in the form of a tool 32 of a tongs-like configuration, and at the head thereof has semicircular regions 33, the length of which approximately corresponds to the length of the rivet sleeves 7 so that the rivet sleeves 7 are respectively enclosed by the regions 33 and can then be compressed by actuation of the levers 35 and 36. The sleeve compressing means 14 may also have a cutting means for cutting off the projecting end 12. A cutting means of that kind is shown in diagramatic form at reference numeral 37.

The prestressing means may also be designed to be adjustable for example, by way of screwthreads so that adjustment of the prestressing force is effected by a rotary movement. The prestressing force may be measured by way of a pressure measuring cell, wherein the attainment of the desired level of prestressing force can be indicated by a signal, for example, a light signal. Adjustment of the desired level of prestressing force may be effected at the pressure measuring cell.

I claim:

1. In combination, an individual string for fitting in a racket used for ball games, in particular tennis, said string having first and second rivet sleeves mounted adjacent opposite ends, a racket having a frame with inside and outer surfaces and aligned holes formed on opposite sides of said frame for receiving said string passed therethrough by means of a stringing device, and a stringing device including tensioning means for exerting tensile stress on said individual string and including a contact portion adapted to be mounted on said outer surface of said racket frame, a holding portion for engaging said inside surface of said racket frame, said holding portion including means movable relative to said contact portion for adjustment to accommodate frames of different thicknesses, prestressing means for said string on said contact portion including an actuating lever having clamping means for holding tension on said string, measuring means for indicating the level of prestressing achieved, and means for compressing said second rivet sleeve tightly on said string while said string is maintained in a prestressed condition;

the improvement wherein:

said first rivet sleeve is fixedly mounted at one end of said individual string; and said second rivet sleeve is dimensioned for loosely pushing into said string after said string has been inserted through an aligned hole on said opposite side of said frame, said second rivet sleeve being compressed to hold a fixed position on said string while tensioned by said stringing device.

2. The combination according to claim 1, wherein:

said tensioning means and said compressing means are separate from one another.

3. The combination according to claim 1, wherein:

said measuring means has a scale for indicating the tension on said string.

4. The combination according to claim 1, wherein:

said prestressing means includes ratchet means having a disengageable locking pawl for maintaining said prestressing tension on said string.

5. The combination according to claim 1, wherein:

said holding portion is displaceably mounted on said contact portion.

6. The combination of claim 1, wherein:

said first and second rivet sleeves have internal grooving for gripping said string when said sleeves are compressed.

7. The combination of claim 1, wherein:

said rivet sleeves are respectively longer than the thickness of said racket frame between said inside and outer surfaces.

8. The combination of claim 1, wherein:

said rivet sleeves have enlarged rivet heads bearing against an annular bearing surface around said holes on said frame on said outer surface thereof.

9. The combination according to claim 8 including:

an annular ring of resilient material disposed between each of said rivet heads and an adjacent annular bearing surface around said holes in said frame.

10. The combination according to claim 8, including:

a protective tube for enclosing said rivet sleeves.

* * * * *